United States Patent [19]

Lechner

[11] Patent Number: 4,681,309

[45] Date of Patent: Jul. 21, 1987

[54] SURGICAL PREP BLOCK AND SURGICAL ASSIST BLOCK

[76] Inventor: Paula Lechner, 19 D'Arcy La., Asheville, N.C. 28804

[21] Appl. No.: 862,293

[22] Filed: May 12, 1986

[51] Int. Cl.[4] ..... A61G 13/00

[52] U.S. Cl. ..... 269/328

[58] Field of Search ..... 254/DIG. 4, 101; 248/371; 108/6; 5/434–437; 269/328, 71, 79

[56] References Cited

U.S. PATENT DOCUMENTS 2,509,086 5/1950 Eaton ..... 269/328

3,106,111 10/1963 Denisco ..... 269/71

4,504,050 3/1985 Osborne ..... 269/328

*Primary Examiner*—Robert C. Watson

*Attorney, Agent, or Firm*—David M. Carter

[57] ABSTRACT

There is provided a surgical support apparatus which may be used as a prep block or surgical assist block. The apparatus is particularly useful for supporting human extremities whereby the extremity is prevented from touching any non-sterile surface while being prepped for surgery or during a surgical procedure. The block includes a stand and a curved surface adapted to swivel at various angles with respect to the stand so that the block may be utilized for various sizes of patients and various extremities, such as arms and legs.

5 Claims, 5 Drawing Figures

SURGICAL PREP BLOCK AND SURGICAL ASSIST BLOCK

BACKGROUND OF THE INVENTION

This invention relates to medical apparatus useful in surgical preparation during certain surgical procedures. More particularly, it relates to support apparatus used prior to and/or during surgery on extremities, such as hands, feet, and knees.

Before the surgeon operates on a person, it is very important that the skin at and near the place where the surgery is to occur is totally clean and free from bacteria. Obviously, this is necessary to prevent infection in the area where the incision is to occur. Normally, antiseptics such as Betadine are applied around the area where the surgery is to occur. Problems arise, however, where surgery is to occur on human extremities such as the feet and the hands, primarily because during the antiseptic preparation, the hands or feet may come in contact with foreign objects such as the operating table itself before it is prepped as a sterile environment. Therefore, it is highly desirable for the patient's extremity to be kept elevated, with the only contact being that of air, which, in the operating room, is maintainted substantially aseptic.

Medical personnel have attempted to remedy this problem by utilizing foam rubber blocks, pillows, and other crude apparati which may be placed under the patient's upper arm (axilla) in the case where the surgery is to be on the patient's hand. However, these solutions have not been found to work well, primarily because the patient's arm may move and come in contact with a non-sterile surface. Furthermore, because patients come in different sizes, the foam rubber blocks are not very acommodating. It is not believed that there is a surgical prep block on the market today which overcomes the above problems.

U.S. Pat. No. 2,850,342 shows an amputation surgery limb support which utilizes a stirrup-shaped device attached to a trapezoidal shaped block which is adapted to swivel about, but it remains in the horizontal plane. However, the amputation surgery limb support device does not deal with the surgical prep problem set forth above.

OBJECTS OF THE INVENTION

It is one object of this invention to provide an improved surgical prep block.

It is another object to provide a surgical prep block specifically adapted for supporting extremities.

It is another object to provide a surgical prep block which may be utilized by different sizes of patients.

It is still another object to provide a surgical prep block which may be used for both hand and arm surgery and lower extremity surgery.

It is another object to provide a surgical prep block that is more conforming to the patient and therefore more comfortable.

It is another object to improve the angle in which the extremity rests to prevent contact with a non-sterile surface.

It is another object of this surgical prep block to be used during various surgical procedures to enhance comfort and accessibility to different areas.

It is another object of this invention to provide a surgical block which may be autoclaved.

SUMMARY OF THE INVENTION

In accordance with one form of this invention, there is provided a surgical prep block and surgical assist block for supporting extremities including a stand having a base and a pair of opposing sides extending upwardly from the base. An extremity support platform is also provided having a surface and a pair of opposing sides extending downwardly from said surface. Each of the upwardly extending sides are attached to a corresponding downwardly extending side. A swivel mechanism is connected to the places where the sides are attached to each other. Thus, the support platform will rotate with respect to the stand and may be locked in various angles.

One advantage of this block is the comfort it gives the patient by having a wide surface area that alleviates the possibilities of impinging any area of the extremity. Another advantage of this block is the ability to swivel and follow the angle of the arm or leg as opposed to a non-conforming surface.

This device may be fabricated of a material such as stainless steel that can be autoclaved. This is an advantage, in that this apparatus may then be used during surgical procedures in order to position the arm or leg for better visibility by the surgeon; it is also more comfortable for the patient.

DESCRIPTION OF THE PREFERRED EMBODIMENT

Figure 1:
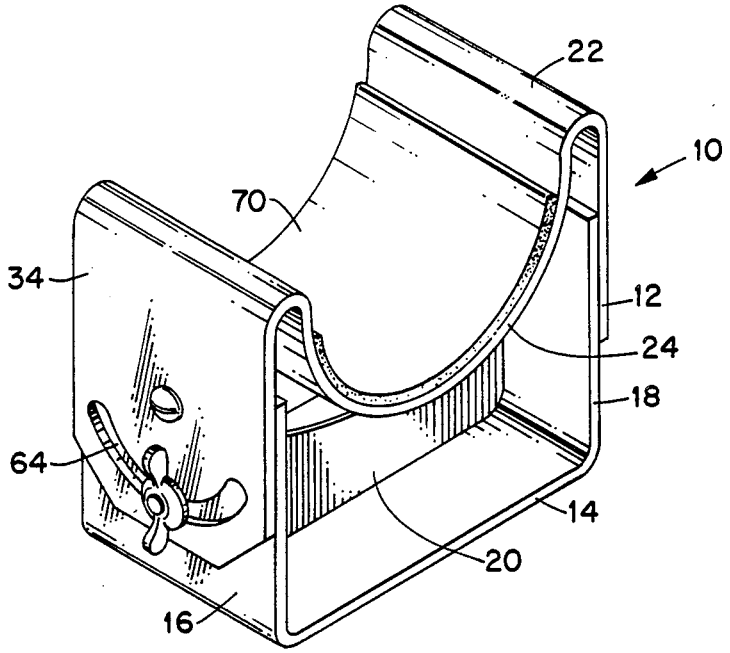
FIG. 1 is a pictorial view of the surgical prep block of the subject invention.
Figure 5:
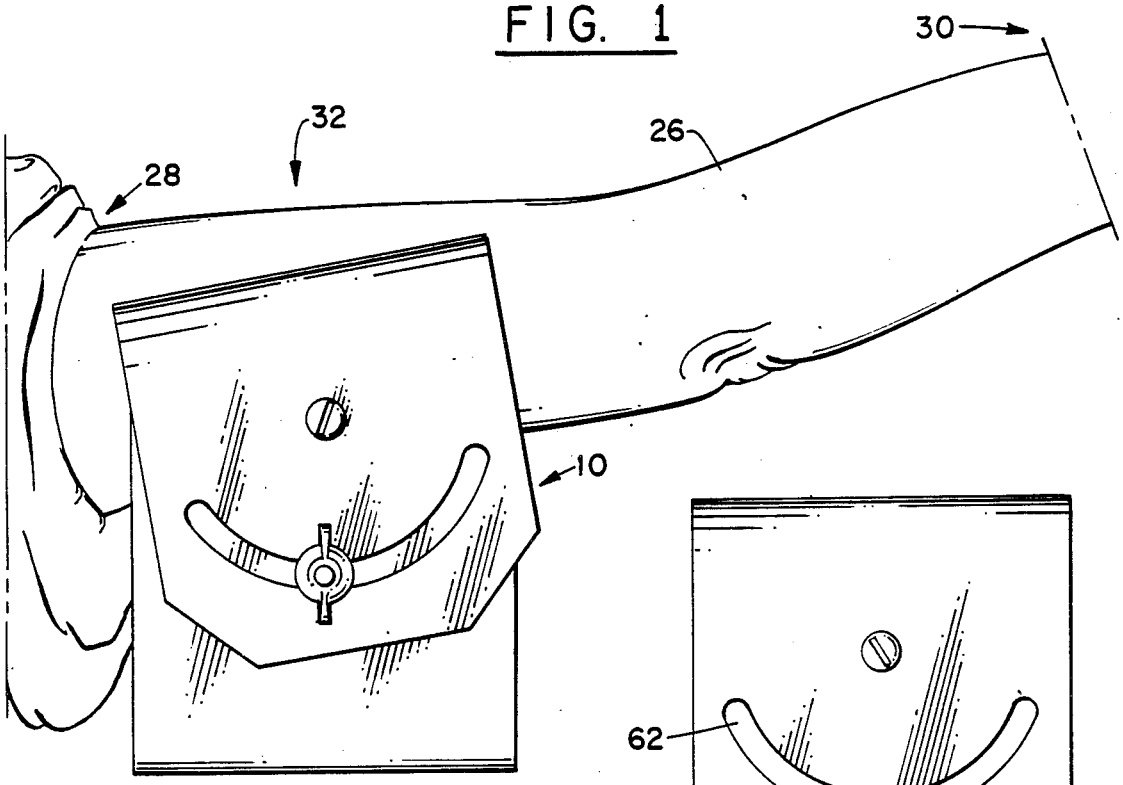
FIG. 5 is a side elevational view of the prep block of FIG. 1 showing a human arm in position to be prepared for surgery.

Referring now to FIG. 1, there is provided surgical prep block 10 having stand 12. Stand 12 includes base 14 and a pair of sides 16 and 18. Support wall 20 is situated between side walls 16 and 18 to provide stiffness for the stand. The prep block 10 further includes support platform 22 having curved surface 24 which receives the human extremity proximally and/or distally to where the surgical preparation is to occur. However, the portion of the extremity which is to be prepared for surgery does not come in contact with surface 24, but extends into the air. This may be seen better in reference to FIG. 5, where arm 26 is received on the prep block 10 with the patient's shoulder 28 almost snug against the side of the prep block, while the hand 30, which is to be operated on, is suspended in air and thus not touching any foreign objects. The only contact between the prep block and the arm is in the humeral portion of the arm 32.

Figure 2:
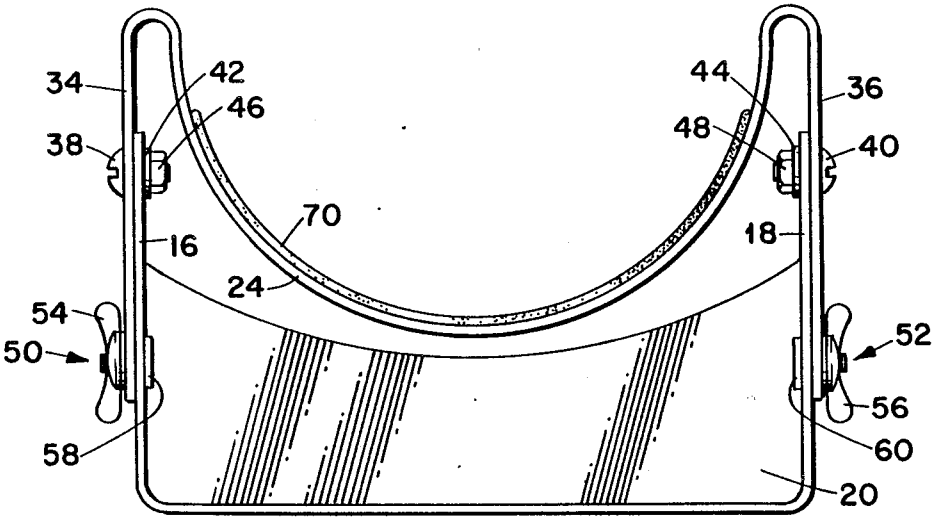
FIG. 2 is a front elevational view of the surgical prep block of FIG. 1.

Referring again to FIGS. 1 and 2, the support platform 22 further includes a pair of sides of 34 and 36 extending downwardly from curved surface 24. Again, as seen from FIG. 2, preferably the curved surface and sides are of a one-piece construction, while the base and sides forming the stand are also of a one-piece construction for ease of assembly.

Figure 4:
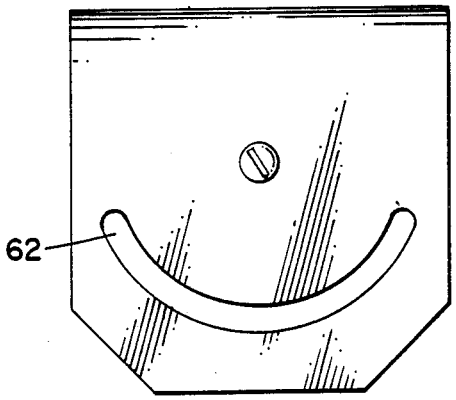
FIG. 4 is a side elevational view of the surgical prep block of FIG. 2 with a portion having been removed.
Figure 3:
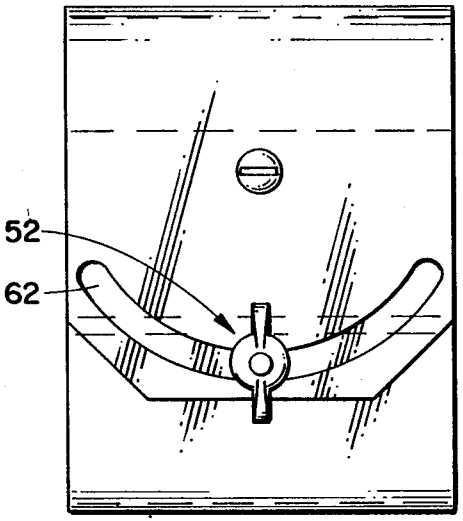
FIG. 3 is a side elevational view of the surgical prep block of FIG. 2.

Side 16 is connected to side 34, and side 18 is connected to side 36 via swivel means which includes shoulder bolts 38 and 40, washers 42 and 44, and nuts 46 and 48. This swivel assembly is somewhat loosely attached in the preferred embodiment, so that the surface 24 will rotate freely, forming various angles with respect to the horizontal or the base 14 of the stand 12. The stand and surface 24 are further connected together by way of locking assembly 50 and 52 which includes wing nuts 54 and 56 and well bolts 58 and 60. Well bolts 58 and 60 extend through curved slot 62, which may be seen in FIG. 4, and slot 64, which may be seen in FIG. 1. Slot 62 is also shown in FIG. 3, as well as its connection to the locking assembly 50. The locking assemblies and 52 enable the surface 24 to be rotated and locked in a specific position, such as that shown in FIG. 5, so that different sizes of patients may utilize the same surgical block apparatus. Furthermore, the same apparatus may also be used for various extremities, including feet and hands.

In another embodiment of the invention where the locking assemblies 50 and 52 are not utilized, the shoulder bolts 38 and 40 will be closed tightly by the nuts 46 and 48 in a specific position or angle of rotation, although it has been found that the preferred embodiment shown with the wing nuts operates better in that the surface 24 does not slip from its predetermined angle of inclination. Cushion 70 may be attached to surface 24 to aid in the patient's comfort.

The apparatus described above may be readily sterilized for each use, particularly if it is made from stainless steel. If stainless steel is used, the support structure 20 might be omitted. It is light in weight and easily transportable from one operating room to another. It is believed that by utilizing the above-described apparatus, fewer instances of infection will occur, because the area which has been prepped for surgery will not come in contact with non-sterile surfaces. Furthermore, the device may also be used during surgical procedures as a surgical assist block in order to position the arm or leg for better visibility by the surgeon and also for improved comfort for the patient.

From the foregoing description of the preferred embodiments, it is apparent that many modifications may be made therein without departing from the true spirit and scope of this invention.

I claim:

1. A surgical prep block or surgical assist block for supporting extremities, namely an individual leg, arm, hand, or foot comprising:

a stand having a base and a pair of opposing sides extending upwardly from said base;

an extremity support platform having a smooth substantially unbroken surface, said surface being configured as a deep inwardly projecting curve for receiving the extremity; and a pair of opposing sides extending downwardly from said surface;

each of said upwardly extending sides being attached to a corresponding downwardly extending side;

swivel means connected to the places where said sides are attached to each other, whereby said support platform will rotate with respect to said stand; said swivel means includes a hole in each of said sides at their respective place of attachment; said holes in each respective upward extending side aligning with said hole in each respective downward extending side;

a pair of rods, each extending through each pair of aligned holes;

a locking means for maintaining said support platform in a fixed position; said locking means includes a curved slot in at least one side in either the upwardly or downwardly extending sides;

clamping means attached through said slot and to the other side, which is attached to said at least one side.

2. A block as set forth in claim 1, further including a cushion attached to said curved surface.

3. A block as set forth in claim 1, wherein said clamping means include a wing nut.

4. A block as set forth in claim 1, further including a support strut between said upwardly extending sides.

5. A block as set forth in claim 1, wherein when said support platform is rotated, an angle of inclination is formed between said surface and said base.

* * * * *